United States Patent [19]

DeYoung

[11] 4,275,638

[45] Jun. 30, 1981

[54] BRAIDING MACHINE

[76] Inventor: Simon A. DeYoung, 5132 Mayview Rd., Lyndhurst, Ohio 44124

[21] Appl. No.: 128,869

[22] Filed: Mar. 10, 1980

[51] Int. Cl.[3] ..... D04C 3/42; D04C 3/06

[52] U.S. Cl. ..... 87/48; 87/29; 87/44

[58] Field of Search ..... 87/44–48, 87/29, 33, 34

[56] References Cited

U.S. PATENT DOCUMENTS

| | | | |
|---|---|---|---|
| 1,888,477 | 11/1932 | Standish | 87/47 |
| 2,464,899 | 3/1949 | Sokol | 87/48 |
| 2,672,071 | 3/1954 | Marogg | 87/46 |
| 3,756,117 | 9/1973 | DeYoung | 87/46 X |
| 3,892,161 | 7/1975 | Sokol | 87/29 |
| 4,034,642 | 7/1977 | Iannucci et al. | 87/48 |
| 4,034,643 | 7/1977 | Iannucci et al. | 87/48 |

*Primary Examiner*—John Petrakes

*Attorney, Agent, or Firm*—Meyer, Tilberry & Body

[57] ABSTRACT

A braiding machine which has higher speeds of operation, versatile material handling characteristics and is able to handle larger lengths of strands between reloads. Inside and outside sets of a plurality, e.g., eight, of circumferentially spaced bobbins are mounted in axially spaced relationship for rotation in opposite directions on a common axis. The carriers for the inside bobbins are also circumferentially spaced and mounted on slotted plates rotatable in the same direction as the outside bobbins. These carriers alternately bridge and clear the slots. An eyelet for each of the outside bobbins rotates in the same direction as the plates and the outside bobbins and synchronously move into and out of the slots to carry the strands from the outside bobbins between, under, between and over adjacent inside bobbins as the supports rotate. The eyelets are guided by semicylindrical bearing surfaces on the supporting frame and are moved through alternating semi-cylindrical paths of movement by notched gears rotatably supported on the frame.

14 Claims, 9 Drawing Figures

BRAIDING MACHINE

This invention pertains to the art of braiding machines and, more particularly, to a braiding machine which is capable of interweaving continuous strands of material to form a braided cover or structure.

The invention is particularly applicable to a braiding machine wherein there are sixteen separate strands to be braided either into a hollow tube or as a covering for another tubular member and will be described with particular reference thereto although it will be appreciated that any number of strands can be braided or one number of strands can be wrapped in one circumferential direction and a different number of strands wrapped in the opposite circumferential direction.

BACKGROUND OF THE INVENTION

Braiding machines have long been used in industry, for example, to braid metallic wire into electrical or electronic cable as a protective armor or into hydraulic hose and cordage as a load bearing structure or into rope, either metal or non-metallic.

One of such braiding machines has been known as a maypole type machine wherein the carriers for the bobbins are moved by horn gears or notched rotors on a deck with all of the carriers following alternating circular or arcuate paths around the braiding point. Half the carriers travel in one direction around the braiding point following one alternating path while the other half of the carriers travel in the opposite direction around the braiding point following another alternating path which crosses the first path at each alternating direction. As the two sets of carriers travel in opposite directions around the braiding point each crossing the path of the other, the strands leaving the bobbins are interwoven as they converge to the braiding point.

With such maypole type braiders, the maximum speed of rotation is severely limited by the need to continuously and repetitively change the path of movement of the carriers and the bobbins thereon. The inertia forces of the combined mass of the carriers and the bobbins, particularly when the strands are metal, is considerable and the vibration and wear caused by changing the direction of movement thereof is a severe limitation on the maximum speed of braiding. In the alternative, the bobbins can be made quite small but in such instances the length of the strands on each carrier is severely limited making it necessary to frequently stop the operation of the machine to replenish the machine with newly filled bobbins.

Another type of braiding machine is known as a rotary braiding machine. In these machines, there is a set of inner carriers, a set of outer carriers and a set of strand deflectors located between the inner and outer carriers. The inner and outer carriers follow a circular path about the braiding point in opposite directions. The deflectors stand in the pathway of the strands from the outside carriers. These deflectors cause the strands from the outer carrier to cross the path of the inner carrier thus interweaving the strands. The interwoven strands then converge to the braiding point to form the braid. The forces on these deflectors are quite high and many strand materials have such resistance to sliding that they cannot be braided on this type machine.

Braiding machines which combine the characteristics of the above two are also known, one being termed a lever arm machine and the other a wheel type machine.

The lever arm machine is similar to the rotary machine except that instead of strand deflectors, the strands from the outer carriers are entrained by lever arms. The lever arms are controlled by a cam track which moves the strands of the outer carriers across the paths of the inner carriers.

In the wheel type machine, which is also similar to the rotary machine, the strand material from each outer carrier is entrained by a wheel. The strand material enters the wheel at the center and emerges at some radial distance from the center. The rotation of the wheel moves the strand materials across the pathway of the inner carrier. With such a machine, obtaining a symmetrical braid has been difficult.

All of such machines have had difficulty handling various types of material. For example, a machine designed for fabric materials will not handle metallic material. Another problem has been that the length of strand on each bobbin is somewhat limited making it necessary to close the machine down frequently to replenish its bobbins.

THE INVENTION

The present invention provides a braiding machine which overcomes all of the above referred to difficulties and others and provides a machine which is versatile in its material handling characteristics, is capable of high speed, has a high strand capacity and will provide a symmetrical braid pattern.

In accordance with the present invention, a frame is provided supporting axially spaced inside and outside bobbin carriers each supporting circumferentially spaced bobbins and rotating therewith in opposite directions about a common axis. The inside bobbin carriers are in the form of a plurality of circumferentially spaced support segments rotatable in one direction on arcuate bearing surfaces on radially slotted carrier plates rotating in the opposite direction such that the segments alternately bridge and then clear the slots. The strands from each outside bobbin are each carried axially past the inside bobbin carriers by individual elongated tube members or eyelets. Means are provided for rotating the eyelets in circumferentially spaced relationship in the same direction and at the same speed as the slotted plates but on alternating semi-cylindrical paths of movement so that they move radially inwardly through an open slot, circumferentially under an inside carrier segment and its bobbin while the segment bridges the slot, and thence radially outwardly of the slot as the segment clears it, and then circumferentially over the next adjacent bobbin as its segment bridges the slot.

Because the weight of the eyelet is independent of the weight of the material on the bobbin and can be substantially less than even an empty bobbin, the speed of rotation can be much higher than in other known braiding machines.

In accordance with one aspect of the invention, the means include the frame having outer and inner portions having respectively alternating inwardly and outwardly facing semi-cylindrical bearing surfaces on the frame with centers of curvature on a common circle and radiuses such that the surfaces circumferentially overlap and the eyelet has bearing surfaces of a diameter equalling the overlap engaging these bearing surfaces to support the tubular members in an axially extending position as they move.

Further in accordance with the invention, these surfaces are axially offset so that the eyelet bearing surfaces may be bearing supported sleeves that always rotate in one direction as the eyelet is guided first by one surface and then the opposite facing surface.

Further in accordance with another aspect of the invention, the means includes two sets of a plurality of notched gears, one set rotatably supported on the inner frame portion midway between the outwardly facing bearing surfaces and the other set rotatably supported on the outer fram portion midway between the inwardly facing bearing surfaces with the axes of rotation being located on the centers of curvature of respective radially opposite bearing surfaces. Each notched gear is a generally cylindrical member having a notch in its periphery which temporarily mates with a surface on the eyelet and propels it along a semi-cylindrical bearing surface. As the eyelet leaves one such surface to move in an opposite direction on the adjacent cylindrical surface, it also leaves such notch and enters another notch in an adjacent notched gear. Ordinarily such gears have conventional gear teeth and adjacent gears mesh, with the notches of each mating as the gears rotate.

Further in accordance with the invention, the support segments are in the form of short links of internally toothed gear rings and such segments are rotated synchronously relative to the slotted plate and eyelets by planetary gears rotatably supported on the slotted plate and a sun gear rotatably supported on the axis of rotation of the inside and outside bobbin carriers.

Further in accordance with the invention, the eyelet has bearing surfaces adapted to engage the inwardly and outwardly facing arcuate bearing surfaces on the frame, which surfaces on the eyelet are bearing supported sleeves of relatively light weight.

Further in accordance with the invention, the gear segments supporting the inside strand carriers are driven in one direction of rotation opposite from the slotted carrier plate by means of planetary gears and a sun gear rotatable about a common axis. In addition, rotor means are provided on the slotted carrier plate outside of the gear segments engaging an arcuate surface on the gear segment to hold them in alignment.

OBJECTS

The principal object of the invention is the provision of a new and improved braiding machine which is capable of higher braiding speeds, is relatively simple in construction and operation, is relatively inexpensive to manufacture and has improved braiding characteristics.

Another object of the invention is the provision of a new and improved braiding machine which is able to handle longer lengths of strand material before requiring reloading.

Another object of the invention is the provision of a new and improved braiding machine wherein the carriers and the bobbins move on circular paths at a uniform speed and the strand guides which move radially in and out between bobbins are relatively light in weight and the machine thus can operate at higher rotational speeds.

Another object of the invention is the provision of a new and improved braiding machine wherein the surfaces guiding the strand guides or eyelets are all portions of true circles and therefore easy and economical to manufacture.

Still another object of the invention is the provision of a new and improved braiding machine wherein the synchronism of the movement of all the parts relative to each other is accomplished from a single drive shaft and is relatively economical to build and to maintain.

Another object of the invention is the provision of a new and improved braiding machine wherein the carriers for both sets of strands all rotate on a generally cylindrical frame member and about a common axis thus contributing to ease and economy of construction and maintenance.

Other and more specific objects will become apparent upon a reading and understanding of the description of the preferred embodiment.

DRAWINGS

The invention may take physical form in certain parts and arrangements of parts, a preferred embodiment of which will be described in detail in this specification and illustrated in the accompanying drawings which form a part hereof and wherein:

FIG. 1 is a cross-sectional view partly in elevation of the lower half of a braiding machine illustrating a preferred embodiment of the present invention, the eyelet in its radially outermost position being shown in solid lines and in its radially innermost position being shown in phantom lines, the relative directions of rotation being indicated by the heads and tails of arrows, all for the purpose of clarity;

PREFERRED EMBODIMENT

Figure 1:
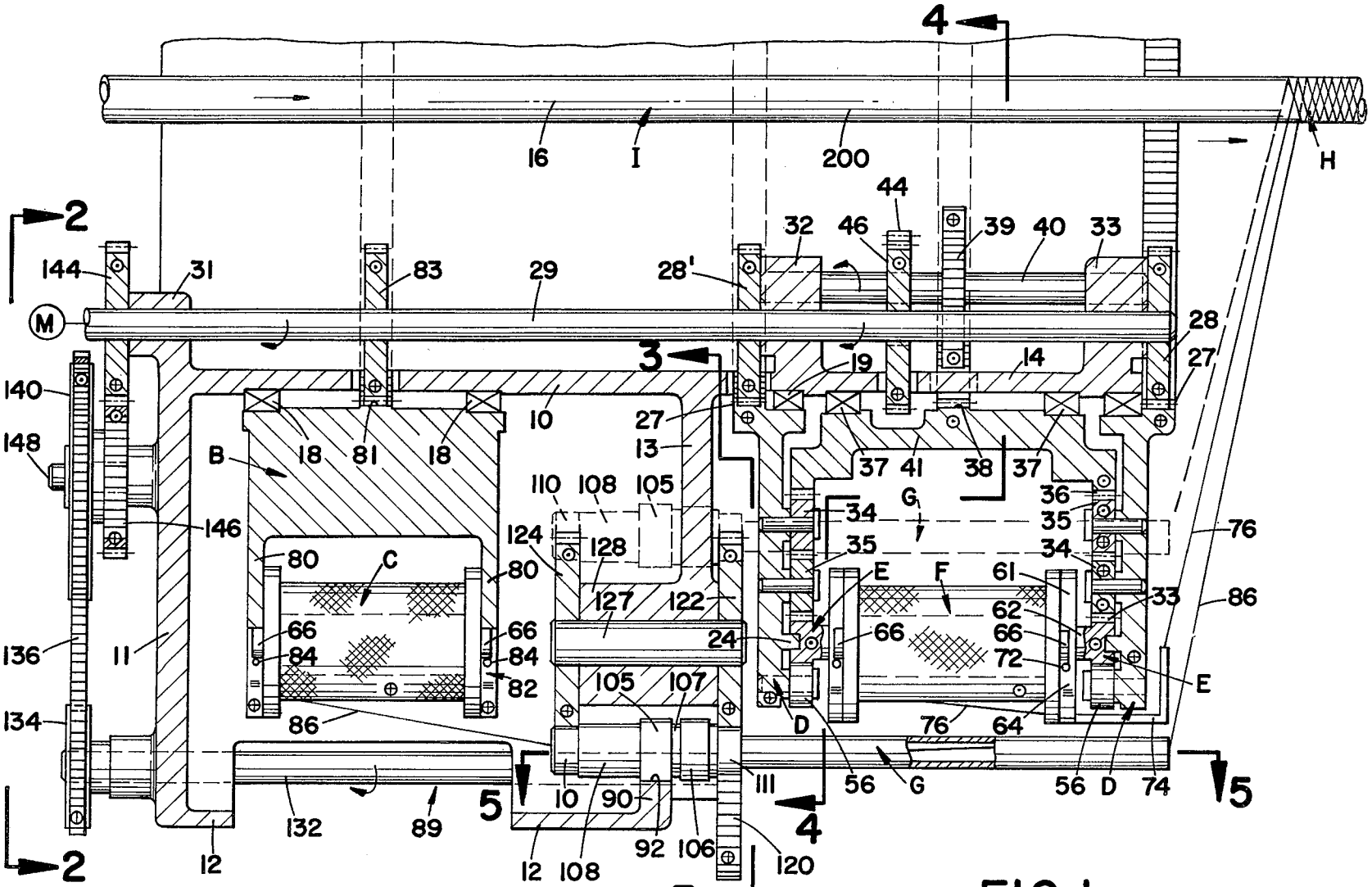
Figure 2:
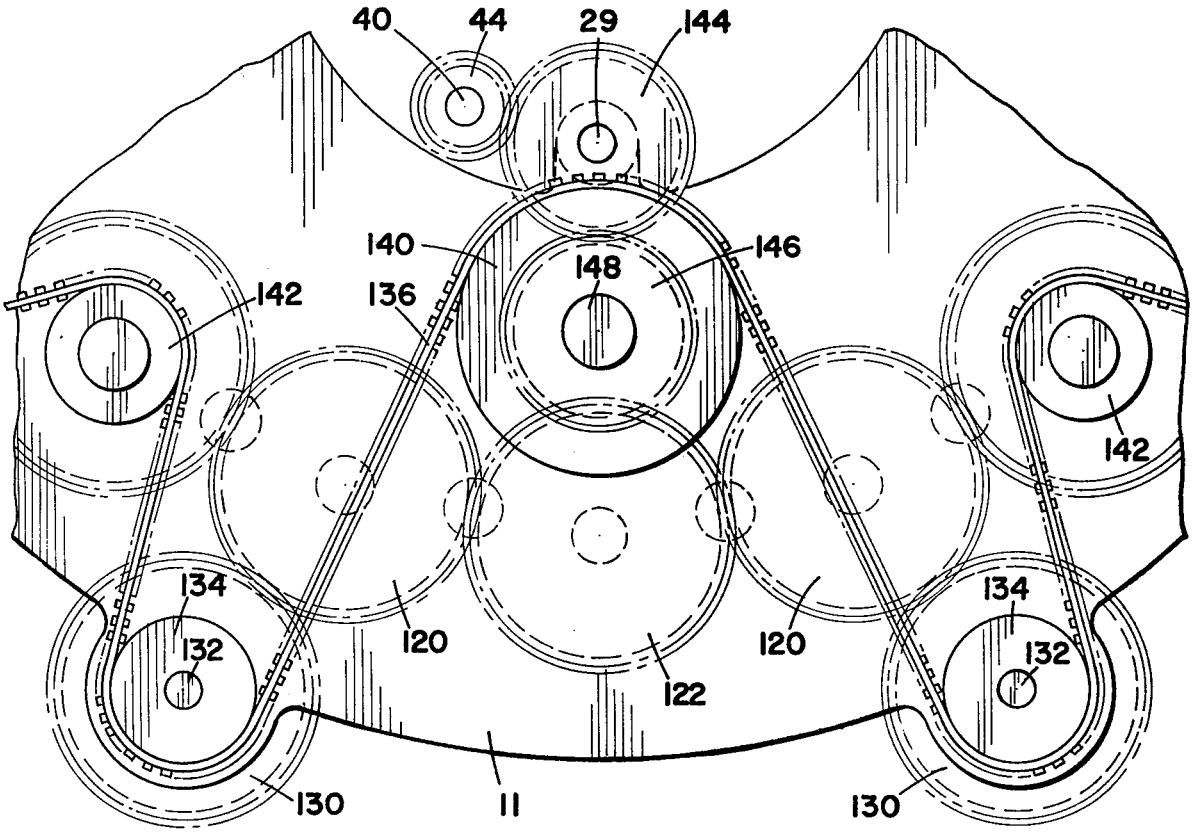
FIG. 2 is an end view of FIG. 1 taken approximately on the line 2—2 thereof.

Referring now to the drawings wherein the showings are for the purposes of illustrating a preferred embodiment of the invention only and not for the purpose of limiting same, FIG. 1 shows the lower half of a braiding machine comprised of: a frame A; an outer (or left-hand) carrier B supporting a plurality of strand holding bobbins C; an inside (or right-hand) carrier comprised of a pair of axially spaced supporting plates D rotatable in a clockwise direction and a plurality of pairs of bobbin support members E movable in a counterclockwise direction. Each opposed pair of these members E supports therebetween a bobbin F holding strands to be braided. In addition, and importantly, the braiding machine has a plurality of eyelets G extending from adjacent the outer carrier B axially past the inside carrier which eyelets G move in a circle around the braiding point in the same direction as the outer carrier on alternating semi-circular paths with the eyelets G passing radially inwardly between, circumferentially under, radially outwardly between, circumferentially over and then radially inwardly back between immediately adjacent inside bobbins. The strands from each carrier emerge from the left-hand side of the machine and converge on a braiding point H around a tubular member I moving from left to right on the axis of the frame A.

The frame A may take a number of different forms but in the embodiment shown is comprised of a generally cylindrical left-hand inner frame member 10, a left-hand end frame member 11, an outer frame member 12, an intermediate frame member 13 and a right-hand inner frame member 14 coaxial with and forming an extension of the left-hand inner frame member 10. For the purposes of clarity, the frame A is shown as being a unitary member although as would be obvious to one skilled in the art of machine design, for ease and economy of construction, this frame would undoubtedly be made in a number of individual pieces which are then rigidly fastened one to the other by either bolting, welding or the like.

The inner frame members 10, 14 have a common axis 16 and the outer carrier member B and the inside carrier member supporting plates D in axially spaced relationship are rotatably supported thereon by means of anti-friction bearings 18, 19 respectively for rotation in a clockwise direction about such axis. For economy of manufacture, these bearings are all preferably of the same size and design. Details of the frame construction to permit easy assembly of conventional bearings are not part of the invention and are within the skill of those in the art and are not shown except somewhat schematically.

There are two identical supporting plates D, one facing right and the other facing left and only one will be described in detail. Thus, the right-hand supporting plate D is in the form of a ring-like disc having a plurality, in the preferred embodiment eight, of slots 20 (See FIG. 4) of a predetermined radial depth and circumferential width extending radially inwardly through the outer edge and leaving therebetween a plurality of radially extending portions 22 of a substantially greater circumferential width than the slots 20. Each portion 22 has on its left-hand surface means forming arcuate bearing surfaces having a center of curvature on the axis 16. Such means may take a number of different forms, but in the preferred embodiment shown is a curved flange 24 having radially inner and outer bearing surfaces 25, 26 and an axially facing bearing surface 27. The inner edge of the plate D is formed to receive the supporting bearing 19 and also has coaxial inwardly facing gear teeth 27 in engagement with a drive gear 28 mounted on a main drive shaft 29 driven by a motor M. This shaft 29 is suitably journaled in bosses 31, 32, 33 formed on the inside of the left- and right-hand inner frame members 10, 14. The other plate D is similarly mounted and is driven by gear 28' mounted on shaft 29.

The bobbin support members E are each comprised of relatively short arcuate segments having an arcuate slot in the right-hand surface slidably mating with the inner and outer bearing surfaces 25, 26. These segments have a total arcuate length approximately equal to the arcuate length of the portions at the flange 24, and the circumferential ends thereof are beveled. The support members E also have gear teeth 33 on their radially inner surface. In effect, these support members E are segments of an inner toothed gear ring and there are eight of such members in circumferentially spaced relationship supported for rotation in a counterclockwise direction as viewed in FIG. 4 on the clockwise-rotating support plate D, all as is indicated by the arrow heads and tails in the drawing.

Figure 4:
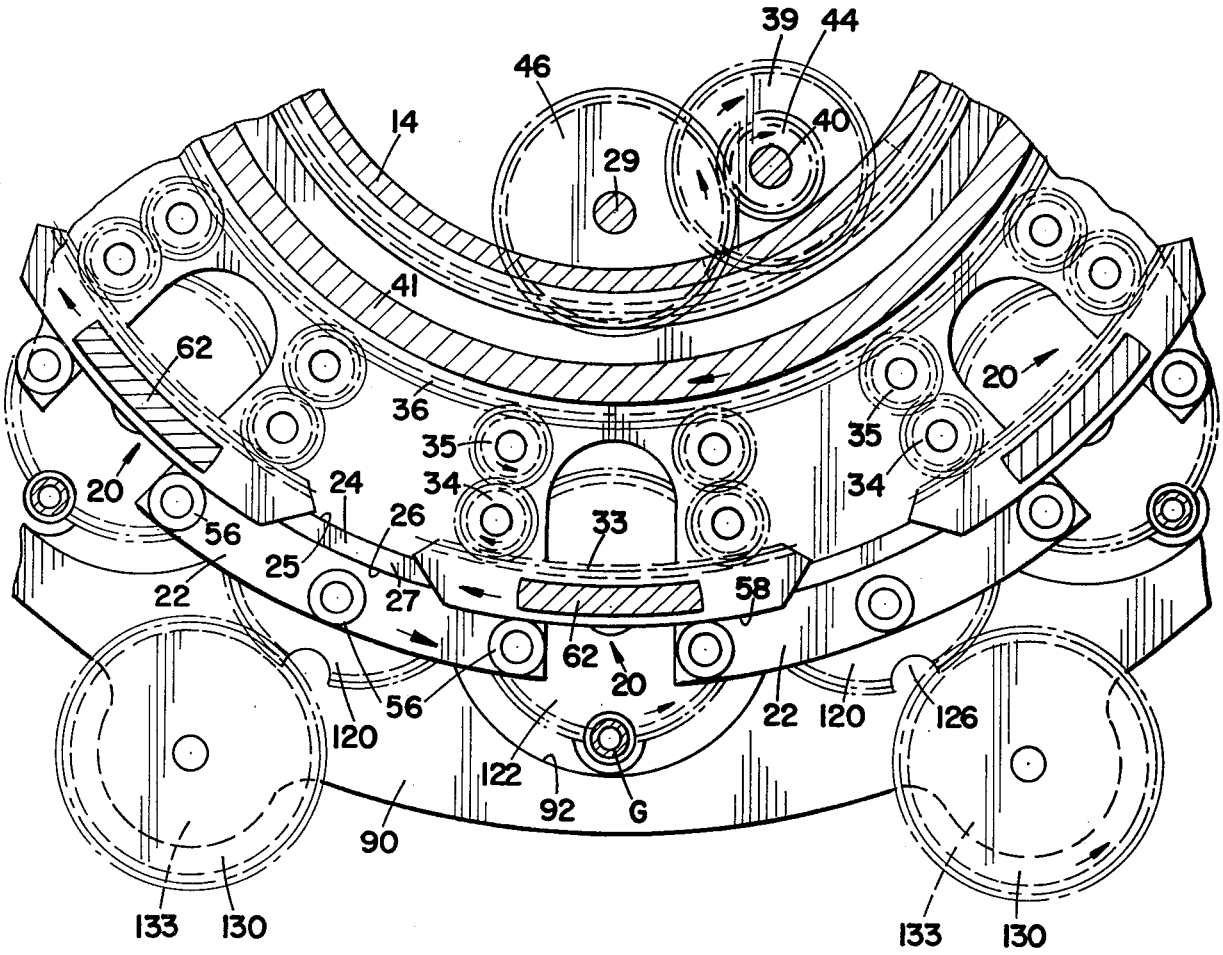
FIG. 4 is a cross-sectional view of FIG. 1 taken approximately on the line 4—4 thereof; and, FIG. 5 is a cross-sectional view of FIG. 1 taken approximately on the line 5—5 thereof.

The bobbin support members E are driven in a counterclockwise direction as viewed in FIG. 4 by a plurality of pairs, one adjacent each side of the slots 20, of planetary gears 34, 35 rotatably supported on the right-hand side of plate D (FIG. 1) and driven by a sun gear 36. There are two such sun gears 36, one associated with the planetary gears 34, 35 mounted on each plate D. These sun gears 36 are mounted on or form part of a sleeve 41 rotatably supported on the right-hand inner frame member 14 by a pair of axially spaced bearings 37. The sleeve 41 in turn has an internally toothed gear ring 38 on its inner surface driven by a gear 39 rotatably supported on the inside of the right-hand frame member 14 on a shaft 40 journaled in bosses 32, 33. Shaft 40 has a gear 44 mounted thereon which is driven by a gear 46 mounted on the main drive shaft 29.

Guide rollers 56 rotatably supported on the right hand side of plate D adjacent the outer edge of the portions 22 engage radially outwardly facing bearing surfaces 58 on each support member E.

As indicated, there are two plates D each identical in construction except for being rights and lefts and each have identical planetary gears 34, 35 and rollers 56 mounted thereon and support members E positioned therebetween.

As the two plates are rotated in a counterclockwise direction, as viewed in FIG. 4, and the support members E are rotated in a counterclockwise direction, the slots 20 will be alternately bridged as is shown in FIG. 4 and then cleared to permit the movement of the eyelets G radially inwardly of the support members E, all as will appear hereinafter.

Each pair of axially spaced support members E have means for releasably supporting therebetween a bobbin F. The bobbins F form no part of the present invention. In general, they are in the form of a spool having short stub shafts 66 projecting axially therefrom. Obviously, they may take any other form. Each support member E has a flange 61 connected thereto by a web 62. Each flange 61 has a radial slot 64 of a width just greater than the diameter of the stub shaft 66 and of a depth radially inwardly beyond the arcuate slot which receives the flange 24. Each bobbin F is positioned between respective flanges 61 with the shafts 66 bottomed in the slots 64 and releasably locked therein by any suitable holding means shown schematically at 72. Such holding means should have sufficient strength to withstand centrifugal forces on the bobbins F as they rotate. As the holding means form no part of the present invention, they are not detailed further.

Each right-hand support member E has a guide 74 which carries the strand 76 from the bobbin supported thereon axially beyond the right-hand plate D from whence it can move radially inwardly to the braiding point H on the axis 16.

The bobbins C are generally identical in construction to the bobbins F although they may be different. They are supported on the outer (or left-hand) carrier B which is generally in the form of a spool rotatably supported on the left-hand frame member 10 by means of the bearings 18. The carrier B has an internally toothed ring gear 81 on its inner surface engaged and driven by a gear 83 in turn mounted on main drive shaft 29. The carrier B has a pair of axially spaced, radially extending flanges 80 each having a plurality of radial slots 82 to releasably receive shaft 66 on the bobbin C. These bobbins are retained in place against the circumferential force by similar releasable retaining means 84 which form no part of the present invention and are not detailed herein. Each bobbin C contains one or more strands 86 which are to be braided. The outer frame 12 has openings 89 therethrough through which depleted bobbins C may be removed and replaced by newly filled bobbins C. Strands 86 are threaded into the eyelet G and move axially past and beyond the right-hand support plate D and the strand guides 74 to then move radially inwardly to the braid point H on the axis 16.

In accordance with the invention, means are provided for moving the eyelet in the same circumferential direction and at the same circumferential speed as the plates D, while at the same time moving the eyelets radially inwardly and outwardly in synchronism with the clearing and closing of the slots 20 such as to move the strands 86 over and under the strands 76 so that they will be braided at the braiding point on the axis 16.

Such means may take a number of different forms, e.g., various types of known complicated escapement mechanisms, but in accordance with the invention and in the preferred embodiment, the outer frame member 12 has on its left-hand end a radially inwardly extending flange 90 having formed thereon a plurality, in this case eight, of radially inwardly facing, circumferentially spaced, semi-cylindrical bearing surfaces 92 and in a like manner, the intermediate flange member 13 has either in radial alignment with or preferably and as shown axially offset from the surfaces 92 an equal number of radially outwardly facing, circumferentially spaced, semi-cylindrical bearing surfaces 96 (See FIGS. 3A to 3E) which are circumferentially offset from the inwardly facing bearing surface 92 so as to be located halfway therebetween. These inwardly and outwardly facing bearing surfaces each have the same radius of curvature with the center of curvature located on a common circle 99 having its center on axis 16. The length of the individual radii are such that the surfaces circumferentially overlap by a predetermined amount.

Figure 5:
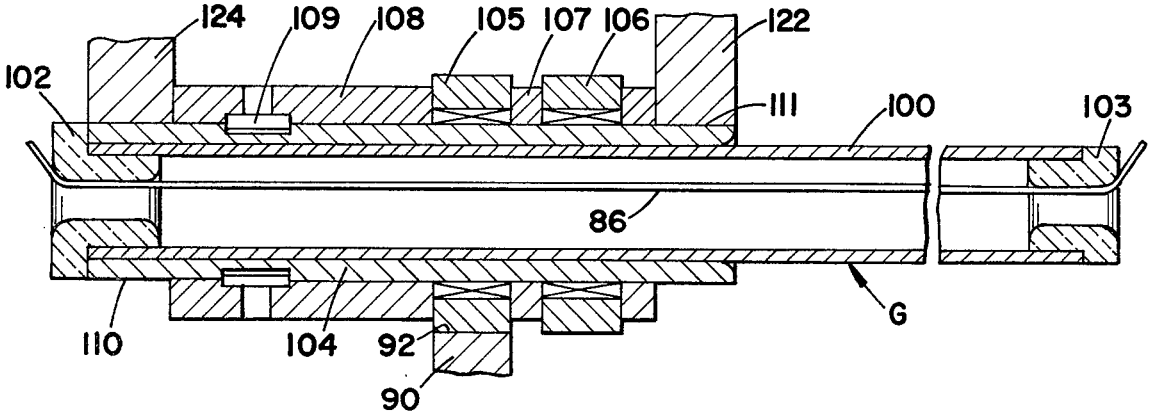

The eyelet G (See FIG. 5) is in the form of an elongated tube 100 of relatively light high strength material such as aluminum, magnesium or fibreglass, with ceramic or hardened steel guides 102, 103 inserted in its ends. A sleeve 104, preferably of hardened steel, tightly fits over the left end of the tube 100. Axially spaced sleeve bearings 105, 106 with a washer 107 therebetween are rotatably supported on the sleeve 104. A retaining sleeve 108 held in place by a lock washer 109 holds the sleeve bearings 105, 106 and the spacer 107 in assembled relationship. Both ends of the sleeve 104 are exposed forming bearing portions 110, 111 for reasons as will appear. The length of tube 100 is such that eyelet G extends from adjacent outer carrier C axially past inside carrier B and guide 74.

Figure 3A:
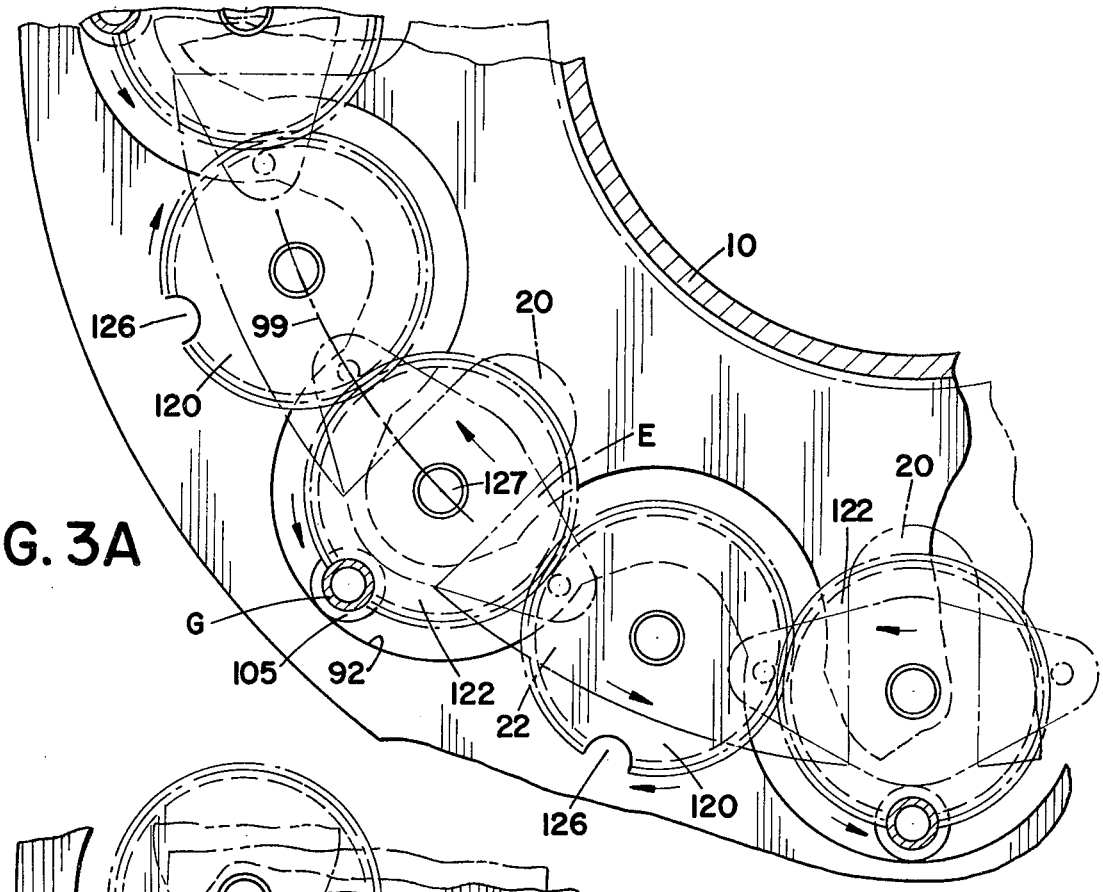
FIGS. 3A to 3E are fragmentary cross-sectional views of FIG. 1 taken approximately on the line 3—3 thereof with the inside carrier member being superimposed thereover in phantom lines, the various views showing the various positions of the notched gears, the eyelets and the inside carrier members as the machine operates.
Figure 3B:
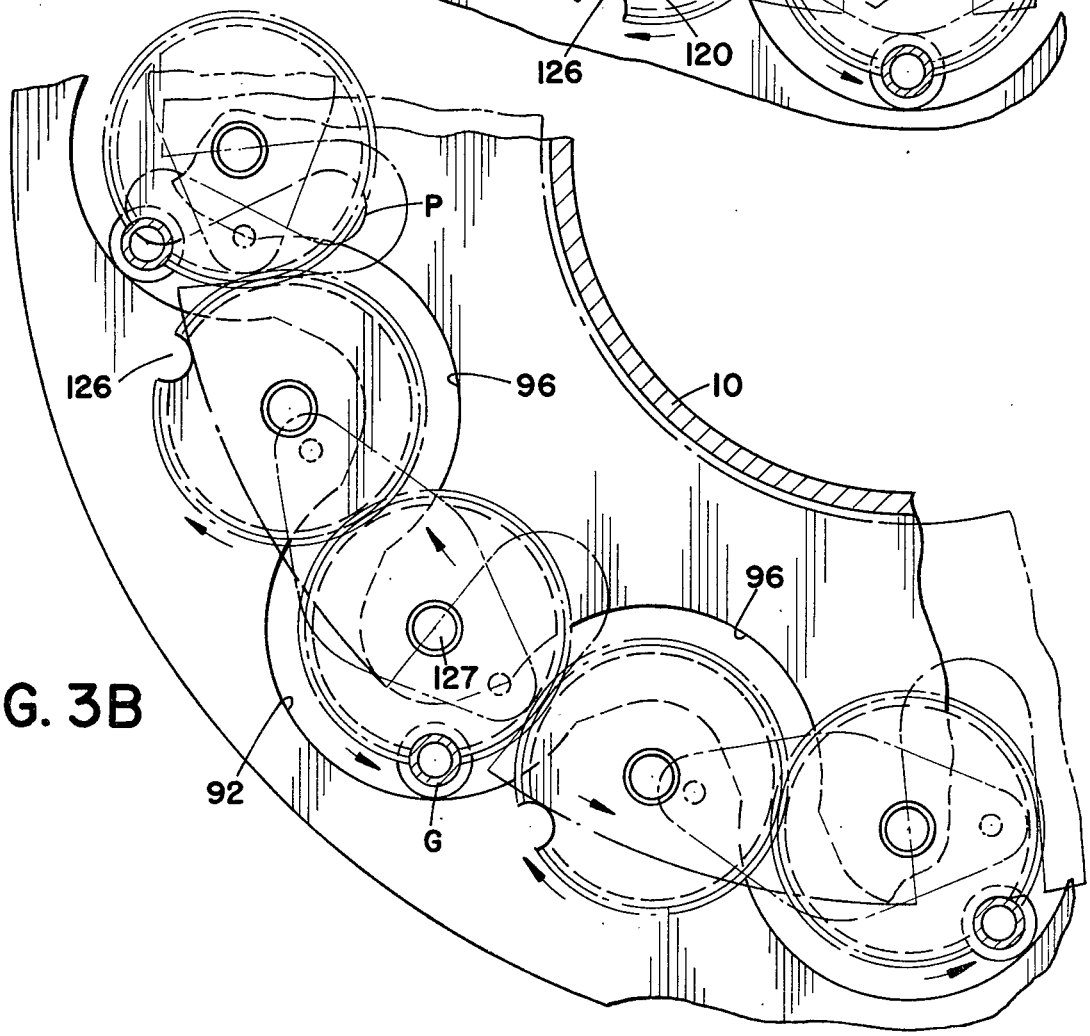
Figure 3C:
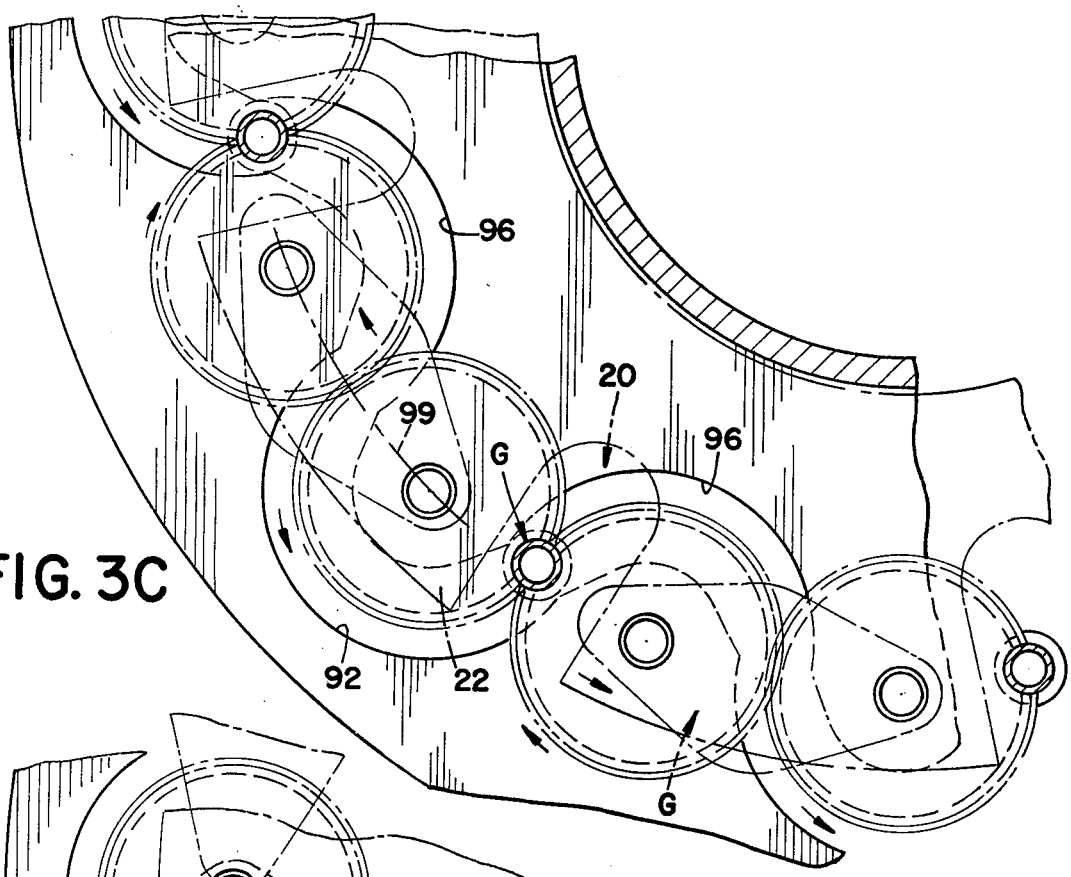
Figure 3D:
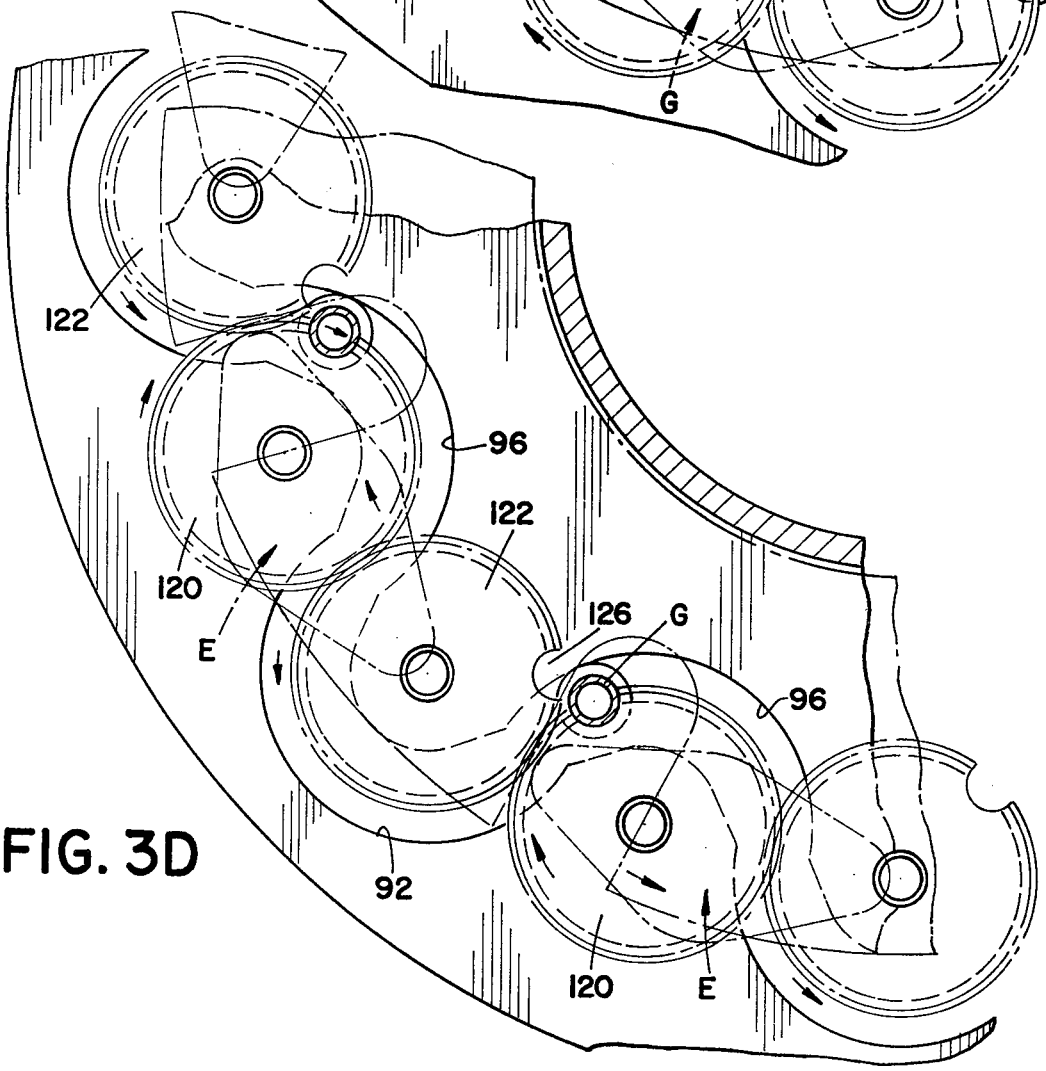
Figure 3E:
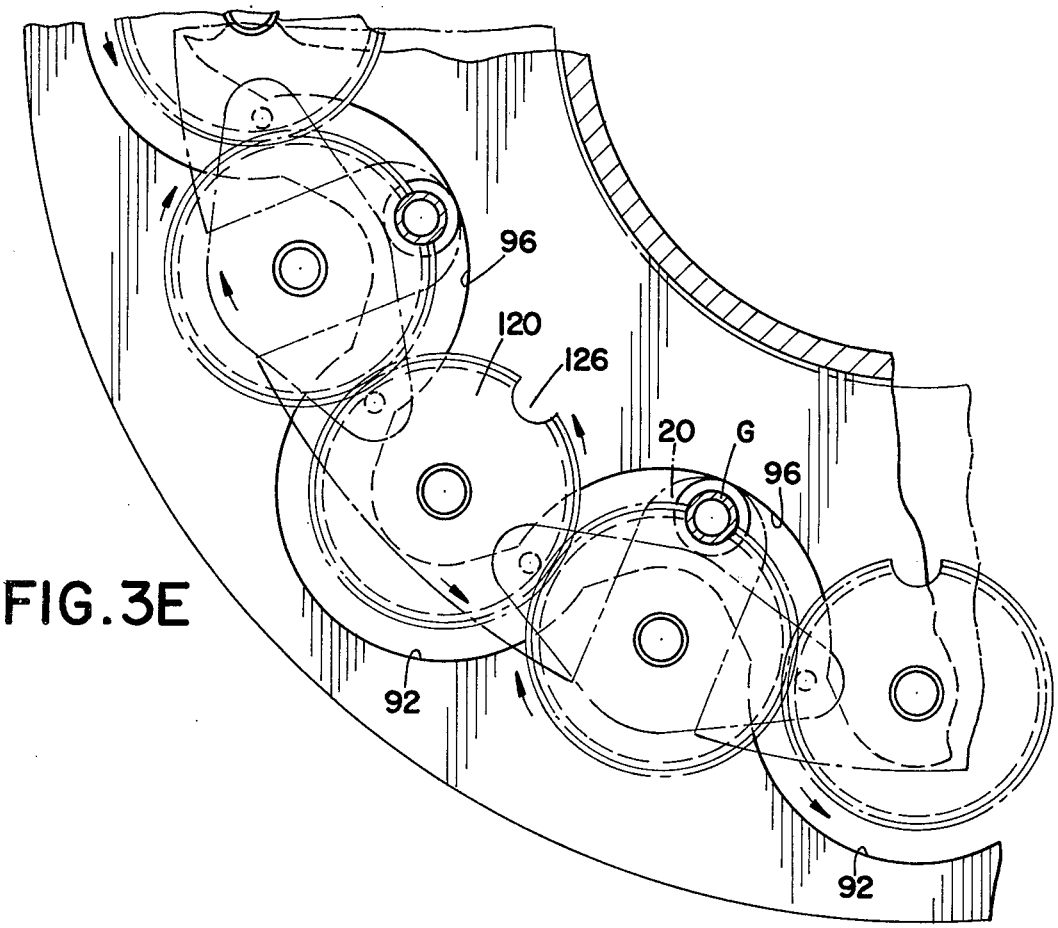

The diameter of the sleeves 105, 106 generally equals the circumferential overlap of the inwardly and outwardly facing bearing surfaces 92, 96. As shown in FIGS. 1, 3A and 3B, the sleeve 105 is in rolling engagement with the inwardly facing semi-cylindrical bearing surface 92. When the eyelet G moves in the course of operation of the braiding machine, it, guided by surface 92, moves radially inwardly. As the sleeve 105 leaves surface 92, sleeve 106 comes into engagement with the outwardly facing semi-cylindrical bearing surface 96 generally as is shown in FIG. 3C. Sleeve 106 is then guided on a semi-cylindrical path by bearing surface 96 as shown in FIGS. 3D and 3E. In this way, the eyelet G is guided on alternating semi-cylindrical paths about the circle defined by the centers of curvature of the inwardly and outwardly facing bearing surfaces 92, 96.

A plurality of notched gears 120 are mounted for rotation on the outer frame member 12 in circumferentially spaced relationship on an axis of rotation corresponding to the center of curvature of the outwardly facing semi-cylindrical bearing surface on the inner frame member 13. In a like manner, a plurality of notched gears 122, 124 are mounted for rotation on the intermediate frame member 13 on an axis of rotation corresponding to the center of curvature of the inwardly facing bearing surfaces 92 and with gears 122 being of a diameter to mesh with the gears 120. Gear 122 is on the right of the intermediate frame member 13 while the gear 124 is on the left side of the intermediate frame member 13. These gears are mounted on and keyed to a shaft 127 journaled in a hub 128 on the intermediate frame member 13. With this arrangement, the centers of rotation of the gears 120 and 122, 124 are all located on the circle 99. Each gear 120, 122, 124 has a semi-cyclindrical notch 126 in its outer surface with the notches 126 on the gears 122, 124 being axially aligned and the notches on the gears 120, 122 being so circumferentially oriented that the notches mate once in each revolution of the gears. These notches 126 form recesses in the surfaces of the gears 120, 122 into which portions 110, 111 of the eyelet G fit so that as the gears rotate, the eyelet G will be moved circumferentially around the frame A but on alternating semi-cylindrical paths inside and outside of circle 99 being advanced first by one gear and then by another and guided by surfaces 92, 96. In the embodiment shown, each eyelet G is thus always supported at three axially spaced points and driven at two axially spaced points.

Gears 120 are each driven by a gear 130 mounted on a shaft 132 rotatably supported in hubs 133 formed on the outside of the outer frame member 12 and extending beyond the left end of end frame member 11 where a sprocket gear 134 is mounted thereon. There are sixteen notched gears 120 mounted around the frame A and there are eight gears 130. Each of the sprocket gears 134 is driven by means of a chain belt 136 which extends over a main drive sprocket gear 140, over the sprockets 134 and over idlers 142 to positively drive all the spur gears 130 at the same rotational speed. The sprocket gear 140 is in turn driven from the main drive shaft 29 by means of a spur gear 144 mounted on the main drive shaft 29 engaging a spur gear 146 mounted on and keyed to the same shaft 148 as the sprocket 140, which shaft is journaled on the left-hand end of the end frame member 11.

All of the notched gears 120, 122, 124 are rotatable on centers located on circle 99. Additionally, the centers of curvature of the inwardly and outwardly facing bearing surfaces 92, 96 are located on this circle. The eyelets G may thus be said to move on alternating semi-cylindrical paths about a circle having a center corresponding to the axis of rotation.

In the embodiment shown, preferably surfaces 25, 26 on flange 24 have a radius corresponding generally to the radius of the circle 99 and the outer periphery of plates D have a diameter such that the eyelets G and guides 74 well clear same.

The depth of slots or openings 20 must be such that the eyelet G will clear the base of the slot as shown in FIG. 3E.

The gear ratios are so selected that the outer carrier B and the plates D rotate at the same speed and, as shown in the drawings, in a clockwise direction viewed from the left-hand side of FIG. 1. At the same time, the segments E rotate in the opposite direction at the same rotational speed. Notched gears 120, 122, 124 are driven at a speed as to move the eyelets G circumferentially at the same speed as plates D with the eyelets G always axially aligned with the same pair of axially aligned slots 20.

In the preferred embodiment shown, shaft 29 is driven to rotate clockwise at 500 rpm. The gear ratio between gears 28 and 28' and 83 and their respective ring gears are such as to rotate the plates D and the carrier B at 125 rpm in a clockwise direction. The ratio of gears 44, 46, 49 is such as to drive the sun gear 36 at 199.05 rpm counterclockwise and the sun gear 41 drives through the planetary gears 35 the bobbin support members E in the opposite direction from the plates D at 125 rpm. The ratio of gears 144, 146, sprockets 140 and 134 is such as to drive the notched gears at 100 rpm in a clockwise direction.

The ratio of gear teeth for gear 46, N1, and gear 44, N2, are defined by the formula:

$$\frac{N1}{N2} = \frac{2\,Nr - Ns}{Ns}$$

where Nr and Ns are gears E and 36 respectively.

Specifically in the preferred embodiment, the gears have the following number of teeth or in the case of the notched gears the equivalent number of teeth:

| | |
|---|---|
| Gears 28, 28', 83, 140, 144, 146 | 40 teeth |
| Gear 46 | 43 teeth |
| Gear 44 | 27 teeth |
| Gears 27, 38, 81 | 160 teeth |
| Gear 36 | 216 teeth |
| Gears 120, 122, 124 (if no notch 126) | 56 teeth |
| Gear segments on E equivalent of | 280 teeth |

Obviously, the main drive shaft may be driven faster or slower than 500 rpm, the exact speed being immaterial so long as the inner and outer carriers are each rotated at the same speed in opposite directions and the equivalent ratio of rotational speed of the notched gears is maintained.

In describing the operation of the braiding machine embodying the present invention, it will be assumed that an appropriate number, e.g., eight, of bobbins C have been positioned on carrier member B and that a strand(s) 86 from each bobbin is led axially from the bobbin through one of the eyelets G and then radially inwardly to the braiding point H. In a like manner, it will be assumed that the same number of bobbins F have been loaded on the bobbin support segments E and that a strand(s) 76 has been led axially through one of the guides 74 and then radially inwardly to the braiding point H.

Only one eyelet G (the only one lettered in FIGS. 3A through 3E) will be traced through a complete cycle, the others all following a parallel path and in synchronism. Thus, FIG. 3A shows eyelet G to be in the 6 o'clock position relative to a radial line and thus in the radially outermost position. Portions 110, 111 of the eyelet G are in notches 126 on one of the inner notched gears 122, 124 and with sleeve 105 in rolling engagement with an inwardly facing bearing surface 92. The eyelet G is aligned with a pair of slots 20 in the two plates D. At this moment, bobbin support segments E bridge slots 20 as is shown in FIG. 4. As the notched gear 122, 124 rotate in a counterclockwise direction, as viewed in FIGS. 3A and 3B, the eyelet G is moved counterclockwise along surface 92 on an arcuate path of movement.

FIG. 3B shows eyelet G in the 4 o'clock position still aligned with the same pair of slots 20 and just about to enter same. At this moment, bobbin support segments E are just about to clear slots 20.

FIG. 3C shows the eyelet G in the 3 o'clock position and thus generally on the circle 99. At this point, the notches 126 in the gears 120, 122 are aligned with portion 111 positioned therein. Sleeve 105 is just about to leave its rolling engagement with inwardly facing bearing surface 92 and sleeve 106 is just about to enter rolling engagement with the outwardly facing bearing surface 96. Bobbin support segments E have cleared slots 20 and eyelet G has moved approximately halfway into slots 20 and between a pair of adjacent bobbins F on the inside carrier.

At the same time, the portion 110 has entered notch 126 of gear 124 such that as gears 122, 124 continue to rotate, eyelet G will leave the gears associated with the inwardly facing surface 92 and will be driven associated with an outwardly facing surface on an arcuate path guided by the outwardly facing bearing surface 96.

FIG. 3D shows the eyelets G in the 10 o'clock position on this set of gears and the segments E are about to bridge slots 20.

As the eyelet moves along outwardly facing bearing surface 96, it passes under a carrier segment E and the bobbin supported therebetween. The segments E have at this time moved to bridge the slots 20 with the eyelet G generally in the 12 o'clock position at the base of the slot D as shown in FIG. 3E.

Each eyelet G may be said to move relative to each slot 20 on a generally figure eight path of movement as is shown in phantom lines in FIG. 3B at P. As the gears continue to rotate, the support segments E again clear notches 20 and the eyelet G is free to move radially outwardly of the notch 20 to the position shown in FIG. 3A but advanced one set of surfaces 92, 96 wherein the entire sequence of operation is repeated.

In each instance, it will be noted that the eylets G move about a circle on alternating semi-cylindrical paths of movement passing first over the outside of one of the bobbins F of the fore carrier, thence radially inwardly between a pair of adjacent bobbins, then circumferentially under a bobbin F and then radially outwardly between a further pair of bobbins and then circumferentially over a still further bobbin.

Various means may be provided for maintaining tension on the strands 76, 86 all as is conventional in the art, such means not forming part of the present invention and not being described herein in detail.

It will be appreciated that the strands 76 and 86 may be braided into a hollow tube or may be braided over a center core which may be solid or hollow, all as is conventional in the art. In the embodiment shown, the strands 76, 86 are braided about a tubular core I.

In the embodiment of the invention shown, it will be appreciated that the bobbins C and F all move on a circular path although in opposite directions. The main forces imposed thereon are centrifugal forces. They move at a constant angular velocity. Thus, the weight thereof is relatively immaterial to the speed of operation of the braiding machine.

On the other hand, the eyelets G move first on one cylindrical path and then on an opposite cylindrical path. They are subjected to substantial forces as the direction of movement is changed. However, due to their relatively light weight and due to the fact that each eyelet is physically supported always by at least one of the bearing surfaces 92 or 96 and by the surfaces of the notches in the notched gears, the inertia forces encountered are readily resisted and because the eyelet G can be made relatively light in weight, the speed of operation thereof may be relatively high.

The invention has been described in connection with a preferred embodiment. Obviously modifications and alterations will occur to others upon a reading and understanding of this specification and it is my intention to include all such modifications and alterations insofar as they come within the scope of the appended claims.

Having thus described my invention, I claim:

1. A braiding machine comprising in combination:

a. a generally cylindrical inner frame member having an axis;

b. a generally cylindrical outer frame member coaxial with at least one end of said inner frame member;

c. an end frame member supporting said outer frame member relative to said inner frame member;

d. an intermediate frame member spaced from said end frame member and extending radially outwardly from said inner frame member toward said outer frame member;

e. an outer carrier member in the space defined by said frame members and rotatable in a first direction on said axis, said outer carrier member having means for holding at least a bobbin having strands to be braided;

f. said intermediate frame member having a plurality of equally and circumferentially spaced, generally semi-cylindrical, radially outwardly facing bearing surfaces;

g. said outer frame member having an equal number of equally and circumferentially spaced, semi-cylindrical, radially inwardly facing bearing surfaces at least adjacent to the radial plane of said outwardly facing bearing surfaces and circumferentially offset therefrom by one-half the spacing therebetween;

h. the radius of curvature of said surfaces being the same with the centers of curvature being equally spaced from said axis and being dimensioned such that the ends of said semi-cylindrical surfaces overlap in a radial direction a predetermined amount;

i. an equal number of inner gears rotatably supported on said intermediate frame member, one midway between each pair of the outwardly facing bearing surfaces and on the center of curvature of each inwardly facing bearing surface;

j. an equal number of outer gears rotatably supported on said outer frame member, one midway between each pair of inwardly facing bearing surfaces and on the center of curvature of an outwardly facing bearing surface, all of said gears having a diameter such as to mesh with an adjacent gear;

k. each gear having a notch in its outer surface with the notches so circumferentially oriented that the notches of adjacent gears will mate as the gears rotate;

l. an inner carrier member rotatable on said axis in said first direction and having an equal number of circumferentially spaced, radially extending slots through its outer surface forming an equal number of toothed portions with the base of each slot being at least radially inwardly of the radially innermost portion of said outwardly facing bearing surfaces and the outer ends of said toothed portions being at least radially inwardly of the radially outermost portions of said inwardly facing bearing surfaces;

m. each toothed portion having, between its radial inner and outer ends, an arcuate bearing surface having a center of curvature on said axis;

n. a plurality of circumferentially spaced slide members rotatable in a second circumferential direction on said arcuate bearing surfaces and alternately bridging and opening said slots as the members rotate, each of said slide members having means for supporting a bobbin containing strands to be braided;

o. means for rotating said outside carrier and said inside carrier members in said first direction at the same rotational speed;

p. means for rotating said slide members in said second direction at an equal rotational speed;

q. means for rotating said gears at a third rotational speed such that the notches of the inner gears when radially inside of said circle are in generally axial alignment with respective ones of said slots;

r. an equal number of circumferentially spaced eyelet members extending from at least the side of said intermediate frame member adjacent said outer carrier member axially beyond the far end of bobbins on said inner support member, each of said eyelet members having portions adapted to fit snugly in the notches of said gears and having bearing surfaces alternately engage said inwardly facing and then said outwardly facing bearing surfaces;

s. strands from each bobbin on said outside carrier adapted to be guided through said eyelet member past said inside carrier and then radially inwardly generally to said axis;

t. means carrying strands from each of said inside bobbins axially past the end of said inside carrier such that said strands may move radially inwardly generally to said axis; and, u. said eyelet member moving from a point radially outwardly of one inside carrier bobbin to a point radially inwardly of an adjacent inside carrier bobbin and then radially outwardly of a still further adjacent inside carrier bobbin.

2. The braiding machine of claim 1 wherein said inner gears are comprised of two axially spaced gears with the notches of the gears being axially aligned, said outer gear mating with one of said pair of gears, said eyelet member having two axially spaced portions fitting in said axially spaced aligned notches in said gears.

3. The braiding machine of claim 1 wherein said inwardly facing and said outwardly facing bearing surfaces are axially spaced and said eyelet member has equally spaced surfaces movably engaging said bearing surfaces.

4. The braiding machine of claim 3 wherein said surfaces on said eyelet members are rotatably supported on the surfaces thereof.

5. The braiding machine of claim 1 wherein said eyelet member has sleeve members rotatably supported on the surface thereof, one adapted to engage said outwardly facing bearing surfaces and the other adapted to engage said inwardly facing bearing surface.

6. The braiding machine of claim 1 wherein said outer carrier member and said inner carrier member are rotatably supported on the outside of said inner frame member and each have inwardly facing gear teeth, a shaft rotatably supported on the inside of said frame member and having gears projecting through openings in said frame member and engaging said gear teeth to drive said inner and outer carrier members at the same rotational speed.

7. The braiding machine of claim 1 wherein there are two generally identical axially spaced inner carrier members and the means for driving said slide members include planetary gears on said carrier members engaging gear teeth on said slide members and a sun gear rotatably supported on said inner frame member and a gear train between said drive shaft and said sun gear for rotating same in synchronism with said rotating members.

8. A braiding machine comprising in combination:

a. a generally cylindrical inner frame member;

b. a generally cylindrical outer frame member coaxial with at least one end of said inner frame member;

c. an end frame member supporting said outer frame member relative to said inner frame member;

d. an intermediate frame member spaced from said end frame member and extending radially outwardly from said inner frame member towards said outer frame member;

e. an inner carrier member supported for rotation on an axis in a first circumferential direction on said inner frame member on the side of said intermediate frame member remote from end frame member, said inner carrier member having a plurality of circumferentially spaced, radially extending slots through its outer surface forming an equal number of toothed portions therebetween, each toothed portion having between its radially inner and outer ends an arcuate bearing surface having a center of curvature on said axis;

f. a plurality of circumferentially spaced slide members movable on said bearing surfaces in a second circumferential direction and alternately bridging and clearing said slots; each of said slide members having means for supporting an inner bobbin containing a strand to be braided;

g. an outer carrier member between said end and intermediate frame members and rotatable in said first direction on said axis, said outer carrier member having means for holding at least an outer bobbin having a strand to be braided;

h. a plurality of tubular members each of an axial length greater than the axial length of said inner carrier member and the bobbins thereon, each extending axially past said inner carrier member and the bobbins supported thereon, each tubular member being axially aligned with a slot; and, i. means moving each tubular member radially inwardly and outwardly through its respective slot when a slide member clears the slot, and circumferentially under and then over adjacent bobbins and their slide members as said slide members bridge their respective slots.

9. The braiding machine of claim 8 wherein said means include a plurality of circumferentially and equally spaced outwardly facing, semi-cylindrical surfaces on said intermediate frame member and an equal number of inwardly facing, semi-cylindrical bearing surfaces on said outer frame member at least adjacent to the outwardly facing bearing surfaces, said inwardly facing surfaces being circumferentially offset from said outwardly facing surfaces and the centers of curvature of each surface being on a common circle having said axis as a center, the radius of curvature of said surfaces being such that the ends of said bearing surfaces circumferentially overlap.

10. The braiding machine of claim 9 wherein said tubular member has bearing surfaces adapted to movably engage said inwardly and outwardly facing bearing surfaces and the radii of curvature of said surfaces being such that the amount of overlap is equal to the diameter of the tube bearing surface.

11. The improvement of claim 9 wherein said means include a plurality of gears one each rotatably supported on said intermediate frame member midway between the outwardly facing bearing surfaces and an equal number of gears rotatably supported on said outer frame member midway between the inwardly facing bearing surfaces, said gears being rotatable on an axis corresponding to the center of curvature of the bearing surface on the adjacent frame member, said gears all intermeshing and each having a notch which mates with the notch on its adjacent gear as they rotate, said tubular member having bearing surfaces which fit in said notches as said gears rotate whereby said tubular member is alternately guided by first an outwardly facing bearing surface and then an inwardly facing bearing surface in an undulating path about said circle.

12. The braiding machine of claim 8 wherein there are two inside carrier members having opposed bearing surfaces and slide members having means to engage an inner bobbin are movably supported on said bearing surfaces.

13. The braiding machine of claim 12 wherein means are provided for moving said slide members in said second direction.

14. The braiding machine of claim 13 wherein said means comprise a sun gear rotatably supported on said inner housing and planetary gears mounted on the opposing faces of said inner carrier members and said slide members have gear teeth on their inner surface engaging said planetary gears.

* * * * *